US005316251A

United States Patent [19]

McGraw

[11] Patent Number: 5,316,251

[45] Date of Patent: May 31, 1994

[54] SELF-LEVELING PAINT CAN HOLDER FOR LADDERS

[76] Inventor: Raymond V. McGraw, 1427 Bussard Ct., Arden Hills, Minn. 55112

[21] Appl. No.: 106,908

[22] Filed: Aug. 13, 1993

[51] Int. Cl.[5] ..... E06C 7/14

[52] U.S. Cl. ..... 248/210; 248/311.2; 248/315

[58] Field of Search ..... 248/210, 313, 311.2, 248/315, 211, 238; 182/129, 120; 211/81

[56] References Cited

U.S. PATENT DOCUMENTS

| | | | |
|---|---|---|---|
| 160,418 | 3/1875 | George | 248/136 |
| 2,101,245 | 12/1937 | Franco | 248/238 |
| 2,508,258 | 5/1950 | Heinrich | 248/210 |
| 2,895,700 | 7/1959 | Johnson | 248/315 X |
| 3,051,428 | 5/1960 | Schult . | |
| 3,104,859 | 9/1963 | Hoelzel | 248/210 |
| 3,125,317 | 3/1964 | Law . | |
| 3,420,486 | 1/1969 | Baker | 248/210 |
| 3,840,204 | 10/1974 | Thomas | 211/81 X |
| 3,987,993 | 10/1976 | Hopkins . | |
| 4,560,127 | 12/1985 | Ippolito . | |
| 4,702,446 | 10/1987 | Brown . | |
| 4,776,550 | 10/1988 | Storey . | |
| 4,824,060 | 4/1989 | Korda . | |
| 4,949,925 | 8/1990 | Gorecki | 182/129 X |
| 5,031,723 | 7/1991 | Hooten | 182/129 |
| 5,106,045 | 4/1992 | Bezotte . | |
| 5,145,226 | 9/1992 | LaFontaine . | |

FOREIGN PATENT DOCUMENTS 683720 12/1952 United Kingdom ..... 248/210

OTHER PUBLICATIONS

Brochure Entitled "Improvements Do-It-Yourself and Save" Fall 1992-Presented by: Leichtung Workshops.

*Primary Examiner*—J. Franklin Foss
*Attorney, Agent, or Firm*—Haugen and Nikolai

[57] ABSTRACT

A unitary self-leveling paint can holder for providing self-leveling of a paint can in two dimensions. An elliptical frame member is provided having a major and minor axis. The frame has a cylindrical handle extending therefrom along the major axis, and a pair of diametrically opposed notches along the minor axis for receiving and pivotably supporting a paint can about the paint can handle bosses. Alternatively, a semi-elliptical frame member can be implemented. The elliptical frame design facilitates rotation of the received paint can along the major axis and about the minor axis up to 30° from vertical. The apparatus is comprised entirely of aluminum and thus matches standard aluminum hollow rung ladders and is not subject to rusting. Further, the apparatus is not subject to degradation such as from paint drippings since there are no moving parts. In lieu of the cylindrical handle which is adapted to be inserted into a hollow ladder rung, a bracket is provided to pivotably attach the paint can supporting member to solid rung ladders or to hollow rung ladders having inaccessible rung hollows.

20 Claims, 5 Drawing Sheets

10
12
16
18
14
20
22

16
14
12

3
3
20
14
10
12
16

SELF-LEVELING PAINT CAN HOLDER FOR LADDERS

BACKGROUND OF THE INVENTION

I. Field of the Invention

The present invention is generally related to paint can holders adaptable to ladders, and more particularly to self-leveling paint can holders.

II. Description of the Prior Art

A variety of paint can holders are commercially available which are adapted to be used with ladders. These paint can holders eliminate the need for the painter to hold the paint can while painting. Further, these paint can holders are adapted to hold the paint cans level while painting, walking the ladder between painting locations, or elevating the ladder.

Typically, a hollow-rung aluminum ladder is used for painting wherein the rung hollows or openings are accessible from each side of the ladder frame. These openings disposed through the hollow-rungs are ideal for receiving paint can supports. One such paint can support adapted to such a ladder is disclosed in U.S. Pat. No. 4,702,446 to Brown which teaches a ladder caddy having a holding-arm with rubber sleeves which can be inserted into one of the selected hollow-rungs. This device is adapted to receive a standard cylindrical paint can and provide self-leveling of the paint can in only one direction, namely, transverse to the ladder rungs to compensate for the incline of the ladder. It fails to include leveling if the ladder is supported on an unlevel footing, or while adjusting or walking the ladder.

Another paint can holder is disclosed in U.S. Pat. No. 5,145,226 to LaFontaine. This device also includes an elongated segment which can be disposed axially into a ladder rung hollow. A paint can holding frame is adapted to be secured to the inside rim of a cylindrical paint can to provide support. Again, this device is adapted to provide leveling only in a single direction transverse to the ladder rungs, and fails to provide automatic leveling in a second and axial direction along the adjacent ladder rung.

U.S. Pat. No. 3,987,993 to Hopkins teaches a paint can support and brush receptacle which is freely pivotal about a clamp for maintaining a level can and brush regardless of ladder inclination. However, leveling is only provided for in one direction. Thus, if the ladder is tilted slightly due to an uneven footing, or while moving the ladder, leveling is not provided.

Another paint caddy is disclosed in U.S. Pat. No. 4,560,127 which has a paint can receptacle formed of a cylindrical member which can be mounted to either side rail of the ladder frame. This device also maintains the rim of the paint can in a horizontal position regardless of the incline of the ladder. However, this device fails to provide leveling of the paint can in a second direction if tilted sideways due to an uneven footing or while adjusting the ladder.

U.S. Pat. No. 4,776,550 to Storey teaches a paint bucket holder for a ladder having a holder which can be rotated to a predetermined and fixed angle relative to a clamp. Thus, the angle of tilt of the paint bucket can be changed in one direction. However, adjustment in a second direction is not provided.

U.S. Pat. No. 5,106,045 teaches a ladder caddy apparatus which also provides self-leveling in only one direction. A suspension web includes a keyhole slot for facilitating a pivotal mounting relative to the clamp member. U.S. Pat. No. 3,125,317 also teaches a paint can holder providing leveling in a single direction transverse to the ladder rungs.

U.S. Pat. No. 4,828,060 to Korda teaches a paint can holder for hollow-rung ladders. The paint can holder has a supporting cradle and bottom plate for supporting a paint can in a fixed vertical position. The holder has a pivot for providing leveling in only one direction. The pair of diametrically opposed cradles in combination with the bottom plate are provided to prevent sideways movement of the paint can within the cradle. Accordingly, leveling is provided only in a single direction.

U.S. Pat. No. 3,051,428 teaches a self-leveling holding device including a pair of pivoting rings to provide self-leveling vertically and horizontally. An inner ring is pivotably coupled to and disposed within an outer ring, which outer ring is pivotably connected to a frame including a clamping portion. While this device is adapted to provide leveling in two dimensions unlike most of the prior art, the arrangement of the rings is rather intricate and paint drippings can bind and inhibit free rotation of each of the multiple pivot points.

U.S. Pat. No. 3,420,486 to Baker teaches a ladder bracket for providing leveling in two directions, but fails to include any mechanism for restricting shifting and slipping of the paint can within the ring.

OBJECTS

It is accordingly a principle object of the present invention to provide a self-leveling paint can holder for ladders providing leveling in two directions.

It is a further object of the present invention to provide a self-leveling paint can holder which is easily adaptable to hollow rung ladders.

Still yet a further object of the present invention is to provide a self-leveling paint can holder having a reduced number of parts such that the apparatus without moving parts such that it is not subject to degradation due to paint drippings.

It is still yet a further object of the present invention to provide a self-leveling paint can holder which is adapted to be secured to a paint can holder on the opposite side of a common rung, such that one can holder may support paint of one color, and the other holder can support paint of another color such as trim.

SUMMARY OF THE INVENTION

The foregoing objects and advantages of the present invention are achieved by providing a self-leveling paint can holder having an elliptical or semi-elliptical frame with a pair of diametrically opposed recesses for receiving and supporting a paint can. A cylindrical shaft is provided extending outwardly along the major axis of the elliptical member, which shaft is adaptable to be disposed within a hollow ladder rung with a slightly larger diameter and is rotatable therewithin for providing automatic leveling in a first direction. The diametrically opposed recesses are defined along the elliptical member minor axis and are adapted to receive the paint can handle bosses and allow self-leveling in a second direction. The paint can holder has no moving parts with respect to itself and thus is not subject to degradation due to paint can drippings. The elliptical member major axis is defined to allow pivoting of the paint can up to approximately 30° within the elliptical opening.

Still yet another feature of the present invention is a tapped counter bore defined in the distal end of the cylindrical shaft. This tapped recess is adapted to receive a tapped protrusion of another similar paint can holder having a respective shaft also disposed within the common ladder rung for the other side. Each of the shafts of the two paint can holders can be secured together due to common threading such that axial rotation of one holder about the ladder rung corresponds to the rotation of the other. One holder can support paint of one color, while the other holder can support paint of another color such as trim.

In an alternative embodiment of the present invention, a bracket is provided pivotally secured to either the elliptical or semi-elliptical support member such that the support member can be easily adapted to a ladder without a hollow rung, or to a ladder without a rung having an opening accessible along the side frame.

The diametrically opposed recesses defined along the elliptical member minor axis inhibit the paint can from shifting laterally towards the adjacent ladder rung, and are formed of semi-circular recesses conforming to the diameter of the pivot can bosses to facilitate pivoting of the paint can bosses while supported within the elliptical opening.

BRIEF DESCRIPTION OF THE DRAWINGS

Other objects features and advantages of the present invention will become apparent to those skilled in the art through the Description of the Preferred Embodiment, Claims, and drawings herein wherein like numerals refer to like elements.

DESCRIPTION OF THE PREFERRED EMBODIMENT

Figures 1, 2, 3:
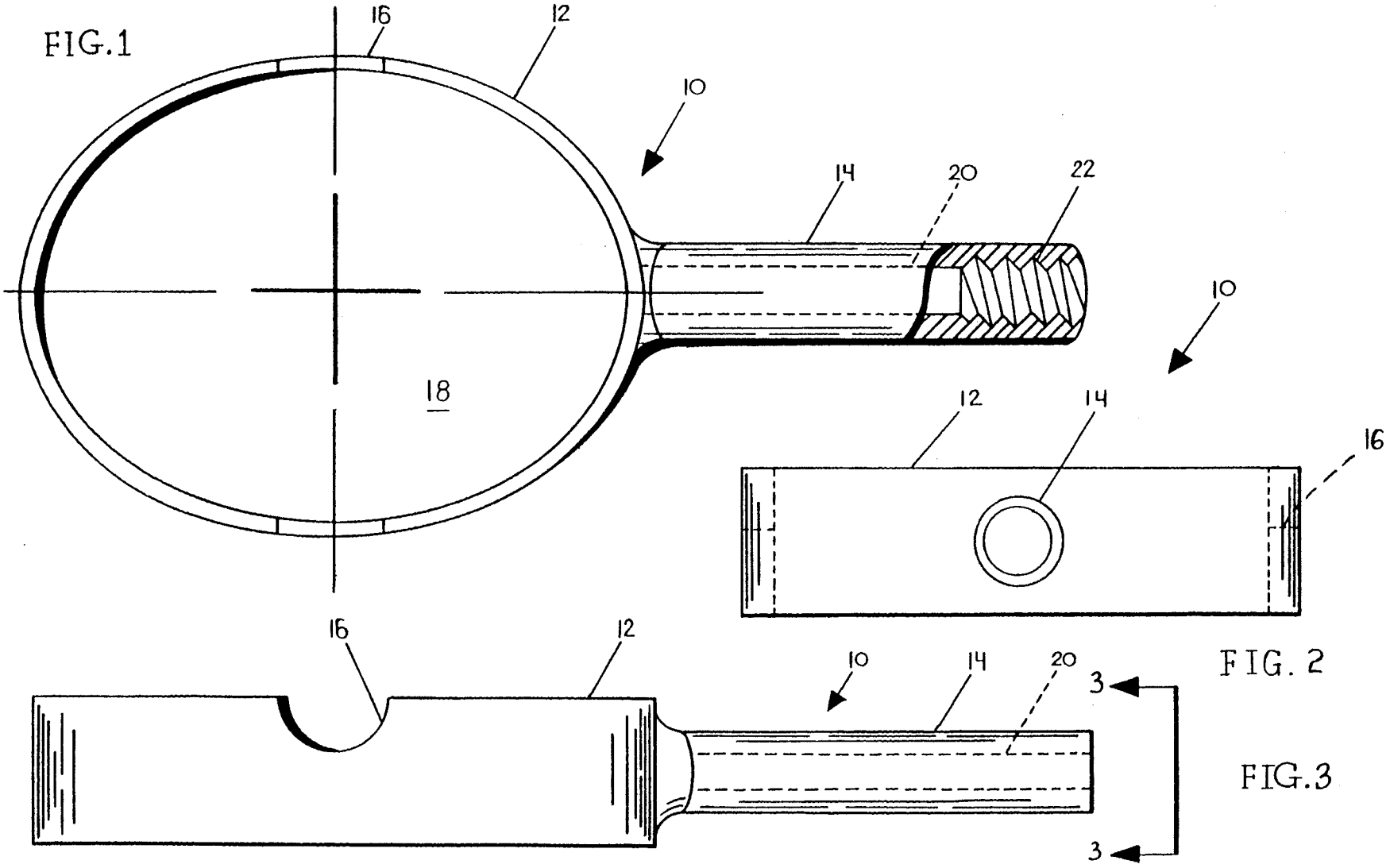
FIG. 1 a top view of a self-leveling paint can holder having an elliptical paint can supporting member with diametrically opposed recesses defined along the minor axis for receiving paint can handle bosses.
FIG. 2 is an end view of the paint can holder shown in FIG. 1 illustrating the semi-circular shaped diametrically opposed notches for receiving the paint can handle bosses along the elliptical member minor axis.
FIG. 3 is an end view 3—3 shown in FIG. 2.

Referring now to FIG. 1, a top view of a self-leveling paint can holder according to the preferred embodiment of the present invention is generally shown at 10. Unitary paint can holder 10 is comprised of a rigid elliptical paint can supporting member 12 with a rigid cylindrical shaft member 14 secured thereto and extending outwardly along the major axis of elliptical member 12. A pair of diametrically opposed semi-circular recesses 16 are defined in elliptical member 12 along the minor axis thereof and each recess 16 extending upwardly therefrom. Each recess 16 has a diameter conforming to the diameter of the handle boss of a standard paint can, such as a one gallon container. Each recess 16 supportingly receives the respective paint can handle boss and allows pivoting of the supported paint can in the lateral direction. Further, each recess 16 restricts shifting of the paint can along the major axis within opening 18 defined by member 12. Rigid shaft 14 is comprised of a hollow tubular member with an axial defined opening 20. A threaded counterbore 22 is provided at a distal end of shaft 14 for securingly receiving a mating threaded protrusion of the shaft of another paint can holder as will be discussed shortly. A variation of this threaded portion includes a mating threaded protrusion at a distal end thereof. (See FIGS. 7 and 9).

Referring now to FIG. 2, an end view of elliptical self-leveling paint can holder 10 shown in FIG. 1 is illustrated. As shown, recess 16 is semi-circular and extends upwardly, but is not deep enough to substantially reduce the rigidity of member 12. Again, each recess 16 is defined along the minor axis of elliptical member 12.

Referring now to FIG. 3, an end view 3—3 shown in FIG. 2 is illustrated to illustrate the tubular and cylindrical handle 14 extending outwardly along the major axis of elliptical member 12.

Figure 4:
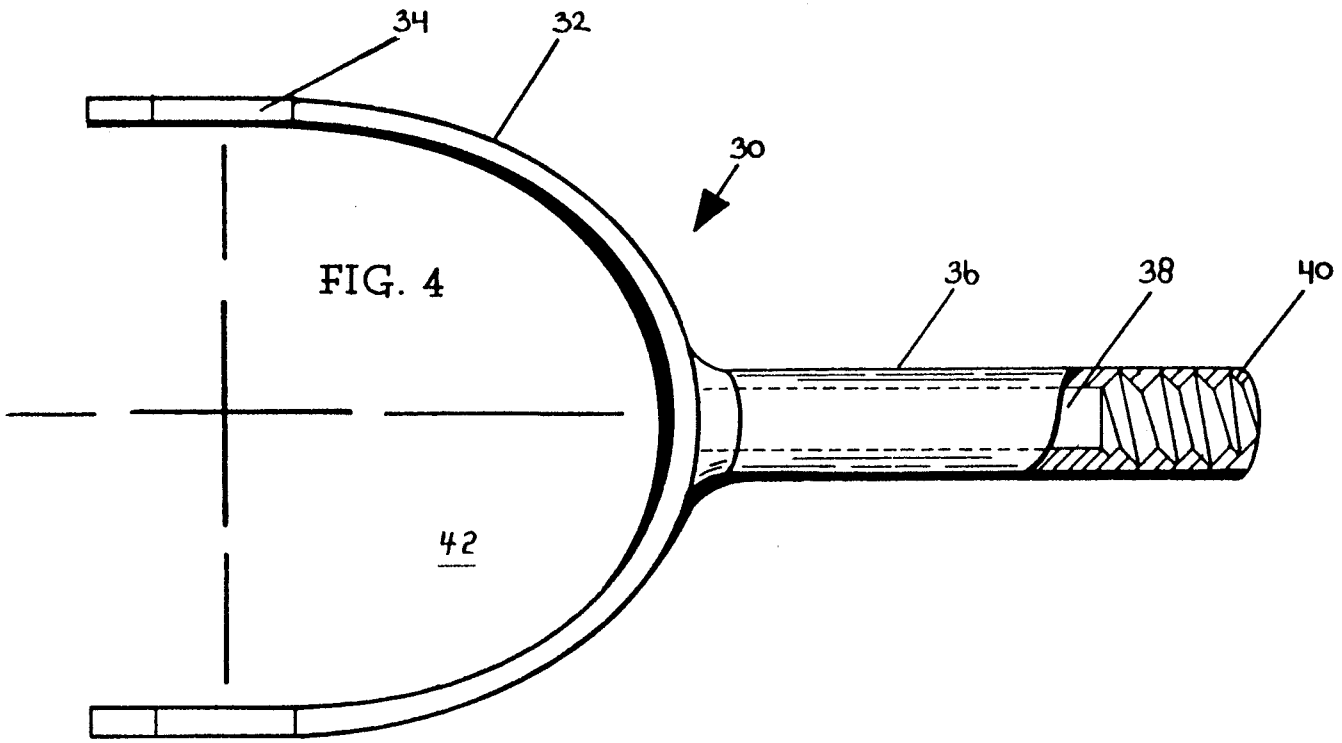
FIG. 4 is a top view of an alternative preferred embodiment of the present invention illustrating a semi-elliptical paint can supporting member also having a pair of semi-circular recesses for receiving a pair of paint can handle bosses.

Referring now to FIG. 4, an alternative preferred embodiment of the present invention is shown and generally shown at 30. Self-leveling paint can holder 30 is characterized as having a semi-elliptical frame member 32 with a pair of diametrically opposed recesses 34 similar to recesses 16 shown in FIG. 1. Each of recesses 34 is defined along the minor axis of semi-elliptical member 32, each recess having a semi-circular profile and opening upwardly. Member 32 extends between a pair of rounded distal ends extending parallel to one another and with the major axis. A rigid tubular handle 36 is securingly attached using conventional welding techniques to member 32 and extends outwardly along the major axis of member 32 as shown. Handle 36 is also tubular and cylindrical, having an opening 38 axially defined therethrough. Opening 38 is tapped at a distal end thereof as shown and is adapted to threadably receive a threaded portion of a second self-leveling paint can holder shaft as will be discussed shortly (see FIGS. 7 and 9).

Figure 5:
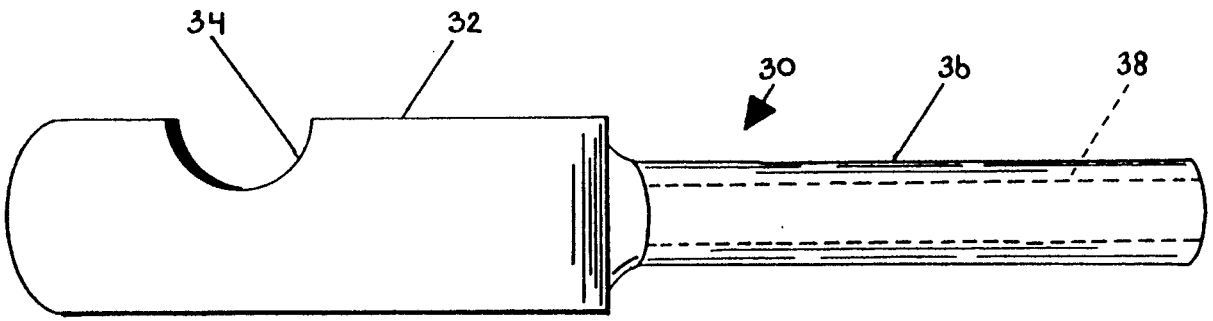
FIG. 5 is a side view of the alternative preferred embodiment shown in FIG. 4.

Referring now to FIG. 5, an end view of paint can holder 30 taken in FIG. 4 is shown. Each recess 34 has a semi-circular shape and opens upwardly. The diameter of recess 34 is substantially identical to the diameter of a standard paint can boss forming a portion of the paint can handle. However, the diameter could be defined slightly larger than the paint can handle boss if so desired. Accordingly, when a paint can is disposed within a recess 42 defined by member 32 with the paint can handle bosses positioned within respective recesses 34, the paint can can easily pivot along the semi-elliptical member 32 major axis but is restricted from shifting along the major axis.

Figure 6:
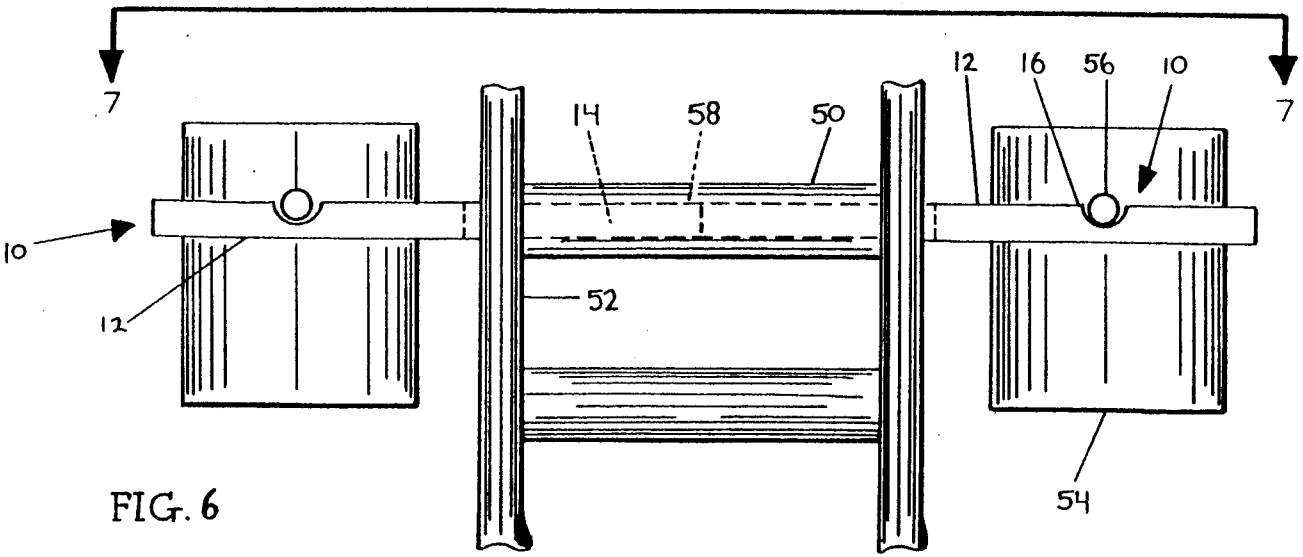
FIG. 6 is an elevational view of an inclined typical aluminum hollow rung ladder receiving a pair of self-leveling paint can holders according to the preferred embodiment of the present invention, wherein each paint can holder shaft is rotatably disposed through a common ladder rung.

Referring now to FIG. 6, a pair of paint can holders 10 according to the preferred embodiment of the present invention are shown adapted to commercially available inclined hollow-runged aluminum ladder. Each cylindrical handle 14 is axially disposed within the same hollowed opening of a chosen ladder rung such as illustrated at 50 until the respective elliptical member 12 closely abuts the ladder frame shown at 52. A standard one gallon paint can shown at 54 is disposed through each opening 18 defined by elliptical member 12 with each diametrically opposed handle boss shown at 56 pivotably received within respective diametrically opposed member recess 16, the recess forming a cradle for each boss 56. Each paint can 54 is self-leveling in a first direction since respective handle 14 is rotatably disposed within the conforming opening 58 of ladder rung 50 such that paint can holder 10 can be axially rotated about the ladder rung axis. Secondly, each respective pair of conforming recesses 16 provide a cradle such that paint can 54 can pivot along the major axis of support member 12 and in the second direction. Accordingly, when a ladder is inclined against a structure and tilted due to an uneven footing, adjusted in height, or moved such as by walking the ladder, paint can holders 10 will automatically level respective paint can 54 both axially about the ladder rung, and also about each recess 16.

Figure 7:
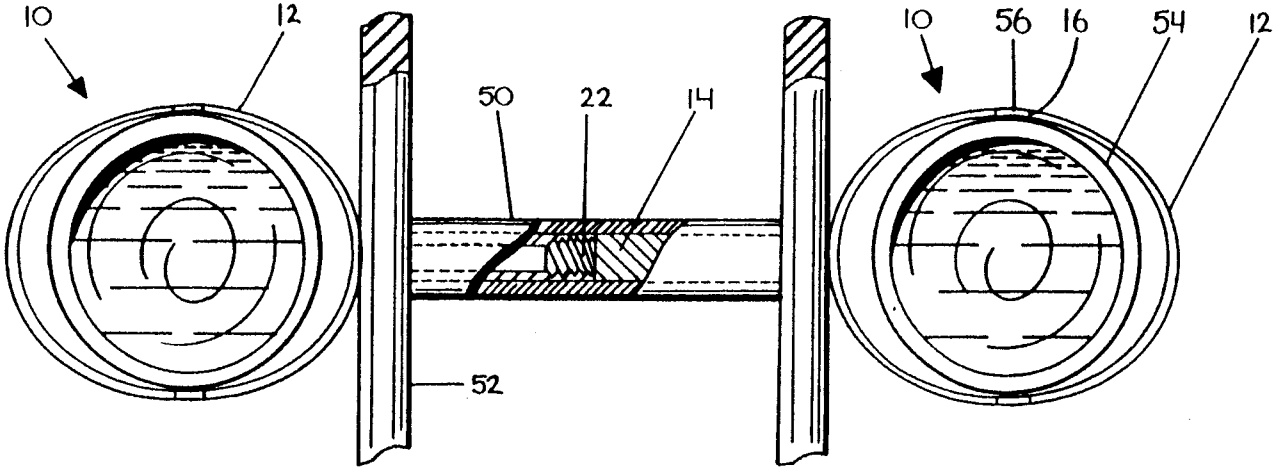
FIG. 7 is a partial-sectional top view 7—7 shown in FIG. 6 illustrating each of the self-leveling paint can holders adapted to an inclined ladder and supporting paint cans in a level position, wherein the distal end of one paint can holder shaft has a threaded bore and the other shaft distal end has a conforming threaded protrusion securingly coupled within the recess of the other, wherein axial rotation of one shaft corresponds to axial rotation of the other.

Referring to FIG. 7, a partial-sectional top view of ladder rung 50 is shown to illustrate one handle 14 having a threaded counterbore 22 at one end, wherein the opposing paint can holder shaft 14 has a threaded axially protrusion which is adapted to be threadably received within threaded bore 22 as shown and previously discussed with reference to FIG. 1. Thus, each of the handles 14 can be secured to one another due to the threaded arrangement. Accordingly, when one elliptical member 12 rotates, the elliptical member 12 of the other paint can holder 10 is similarly rotated axially about the axis of rung 50. FIG. 7 is a top view 7—7 shown in FIG. 6 wherein the ladder is inclined to further illustrate each of the respective paint cans 54 received an self-leveled within the respective elliptical support member 12 of the respective paint can holder 10. Again, each shaft 14 of the respective paint can holders is rotatably received within the conforming opening of the tubular rung 50 to facilitate self-leveling in a first direction. Each of the respective recesses 16 provide self-leveling in a second direction along the major axis of member 12 as previously discussed.

Figure 8:
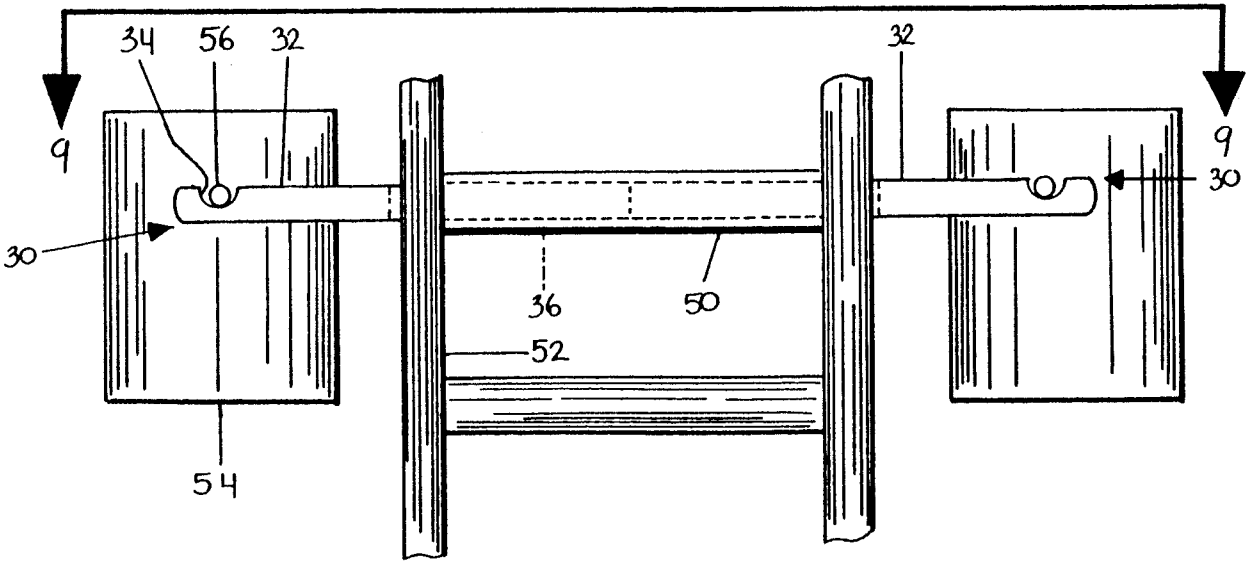
FIG. 8 is an elevational view of the alternative preferred embodiment of the present invention also illustrating a pair of paint can holders adapted to an inclined ladder and having semi-elliptical supporting members each supporting a respective paint can in a level position.

Referring now to FIG. 8, an elevational view of a pair of holders 30 is shown according to the alternative preferred embodiment shown in FIGS. 4 and 5 is shown, each holder adapted to a common standard hollow runged ladder wherein the ladder is inclined. FIG. 8 is distinguishable from FIG. 6 only in that a semi-elliptical paint can support member 32 is provided in place of elliptical support member 12 shown in FIG. 1. Again, each paint can holder 30 is automatically self-leveling in a first direction about the member 32 major axis due to respective shaft 36 rotatably received within opening 58 defined through rung 50, and is also self-leveling in a second direction about the member 32 minor axis due to conforming recesses 34 forming a cradle for receiving respective handle bosses 56 of paint can 54.

Figure 9:
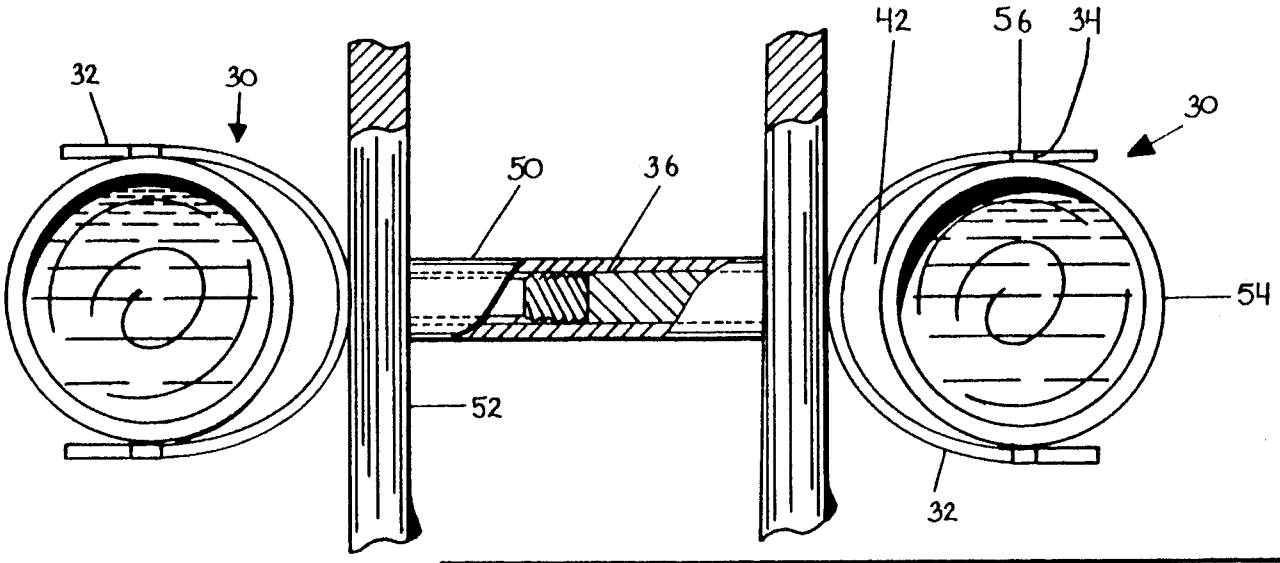
FIG. 9 is a partial-sectional view 9—9 shown in FIG. 8, similar to FIG. 7, illustrating each holder having a mating shaft such that the shafts can be secured together along a mid-section and within a common ladder rung.

Referring now to FIG. 9, a top view 9—9 of the inclined ladder shown in FIG. 8 is shown to illustrate the mating arrangement of each handle 36 within a common rung 50. Again, axial rotation of one handle 30 about the axis of rung 50 corresponds to the rotation of the opposing paint can holder 30 disposed at the other end of the same rung 50. Even though the ladder is inclinded, the paint cans 54 remain level as shown.

Figure 10:
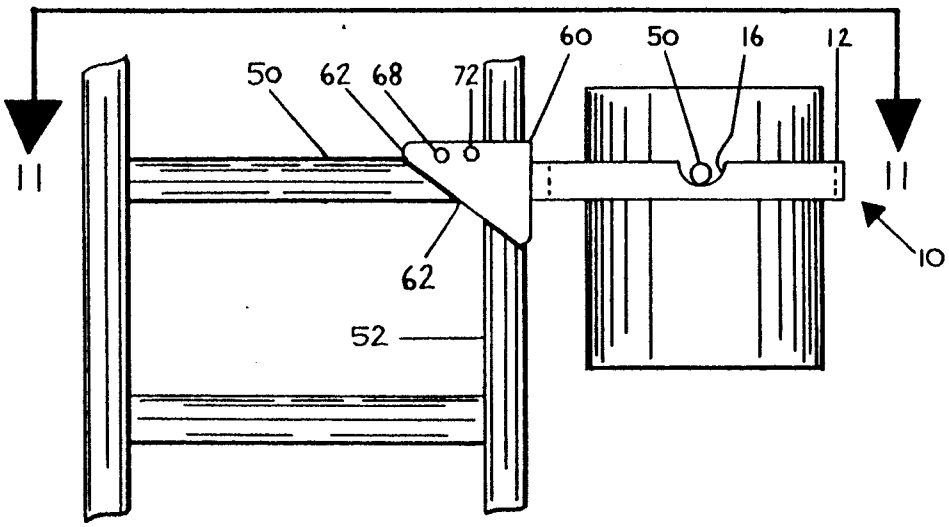
FIG. 10 is an elevational view of a paint can holder adapted to an inclined ladder and having a bracket for pivotably supporting an elliptical paint can holder, which bracket is adaptable to ladders having non-hollow rungs, or hollow rungs which openings are not accessible from the frame side members.

Referring now to FIG. 10, an alternative embodiment to shafts 14 and 36 of paint can holders 10 and 30 is shown. An adjustable bracket 60 is provided which is pivotably coupled to elliptical frame 12. Thus, the paint can holder 10 can be adjustably secured to a standard ladder which has solid rungs, or which has rungs which are hollowed but are inaccessible from the sides of the ladder frame.

Figure 11:
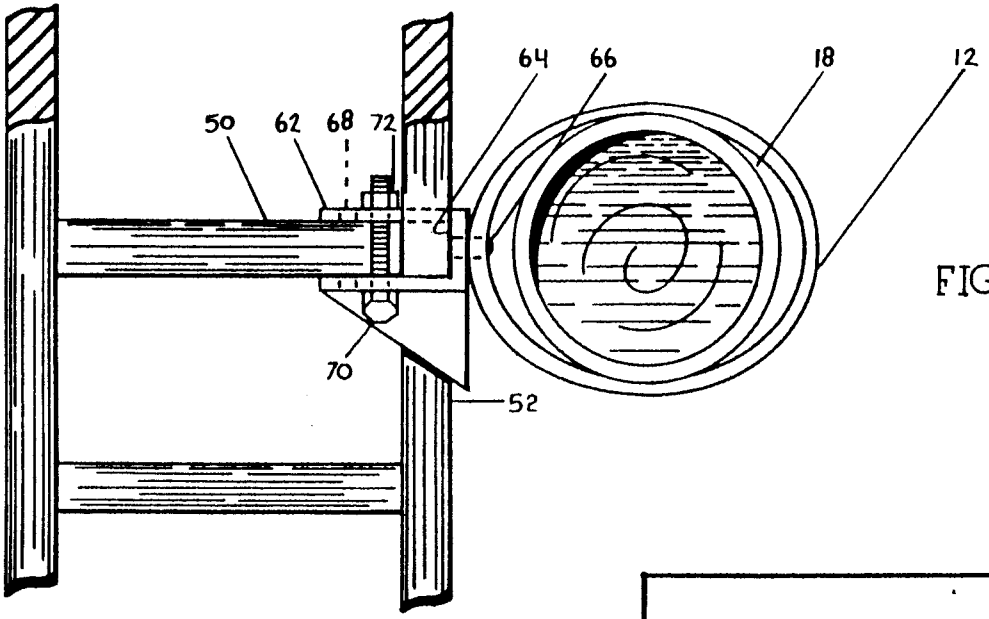
FIG. 11 is a top view 11—11 shown in FIG. 10 illustrating the bracket with a pivoting rivet disposed through the bracket and the end of the elliptical paint can holder along the major axis for facilitating rotation thereabout.

Bracket 60 is comprised of a pair of rigid triangular side plates 62 and a rectangular end plate 64 extending therebetween at one end. A pivoting rivet 66 is provided and which is disposed through an opening in end plate 64 and an opening in elliptical frame 12 along the major axis thereof to provide a pivoting coupling arrangement. Referring to FIG. 11, pivoting rivet 66 extends through a midsection of plate member 64 with one end protruding slightly inward into opening 18 of elliptical member 12. Each side plate 62 is provided with a pair of laterally disposed openings 68, each opening adapted to receive a standard bolt 70 having a shaft axially extending therethrough. A nut 72 is provided for securing bolt 70 to bracket 60 as shown.

During installation, bracket 60 is first disposed over the side frame 52 of the ladder at a selected location, wherein openings 68 are positioned above a chosen rung 50. Subsequently, bolt 70 is disposed through the chosen respective openings 68 of each side member 62 and nut 72 secured to the bolt. The weight of bracket 60 and frame 12 will cause frame 60 to slide downwardly until bolt 70 is rested upon and extending across the adjacent rung 50. Two dimensional self-leveling is provided due to recesses 16 and pivoting rivet 66. Bracket 60 is comprised of aluminum, however, a rigid plastic could be implemented as well, and limitation to aluminum is not to be inferred.

Due to the self-leveling features of both paint holder 10 and 30 shown in FIG. 1 and 4, each holder and an associated supported paint bucket can remain at the top of the ladder as the ladder is adjusted to height or walked by the painter from one painting location to another. Due to the self-leveling in two dimensions, paint in the paint bucket will remain level therewithin and will not splash onto the structure to be painted or the painter below. The diametrically opposed elliptical member recesses defined along the minor axis provide a simple lightweight cradle for supporting the paint can wherein the paint can can simply be inserted therein from above. No time consuming or tedious attachment procedures need to be undertaken to attach the paint can to the respective paint can holder. The ratio of the major axis to the minor axis of the respective paint can holder is designed to provide a pivoting range of the paint can up to 30° from a vertical position. However, limitation to this design is not to be inferred for the ratio of the major axis to the minor axis can be chosen to facilitate a greater or lesser angle of rotation about the elliptical member minor axis.

It is to be recognized that while the preferred embodiment implements either an elliptical or semi-elliptical frame member, a circular or semi-circular frame member could be provided as well with inwardly extending cradle portions in lieu of a notch defined in the frame member. This alternative is a functional equivalent but is a more awkward design.

By way of illustration, the following dimensions for the self-leveling paint can holder 10 are provided, however, limitation to these dimensions are not to be inferred. Preferably, elliptical member 12 has a major axis with an outer diameter of 8 inches and an inner diameter of 7¾ inches. The holder member 12 minor axis has an outer diameter of 6⅞ inches and an inner diameter of 6⅝ inches, and a standard one gallon paint can has an outer diameter of 6⅛ inches and thus does not shift appreciably along the minor axis and can pivot freely therewithin. The height of elliptical member 12 is preferably 1¼ inches, wherein the recesses 16 have a diameter of ⅞ inches. The handle 14 has an outer diameter of 15/16 inches and opening 20 defined therethrough has an inner diameter of 14/16 inches. Handle 14 is approximately 9 inches long.

Preferably, member 12 is formed from ⅛ inch thick aluminum strap formed into an elliptical shape as shown and welded at a seam, and handle 14 is comprised of an aluminum hollow tube. Ideally, handle 14 is welded to elliptical holder 12, however, other fastening arrangements such as bolts could be implemented as well. All construction is formed from aluminum to match the composition of a standard aluminum ladder and provide an aesthetically pleasant apparatus. However, part or all of paint holder 10 could be comprised of plastic such as molded plastic if desired.

In regards to the alternative embodiment of self-leveling paint holder 30, many of the same dimensions apply with the exception that the rounded distal ends of semi-elliptical member 32 extend parallel to each other approximately 1 inch past the minor axis which extends through each diametrically opposed notch 34. Again, these dimensions are for illustration purposes only, and limitation to these preferred dimensions and scaling is not to be inferred.

In summary, the present invention is comprised of a unitary member with no moving parts and is thus not subject to binding and degradation due to paint drippings or rust. The paint can holder facilitates self-leveling in two dimensions and is easily adaptable to aluminum ladders with hollow rungs. However, each disclosed embodiment can be provided with a bracket adaptable to a ladder with solid rungs, or to hollowed rungs which are inaccessible from the sides of the ladder frame. The paint holder provides self-leveling and reduces the likelihood of splashing when moving, or adjusting the ladder, or when moving the holder to a different rung. The entire apparatus is formed of aluminum and thus lightweight such that it matches an aluminum ladder, and which is not subject to rusting. The apparatus is easily formed from only two pieces of material, namely, a predetermined length of an aluminum strap, and a cylindrical aluminum handle welded thereto along the elliptical major axis. The handle can be adapted to couple to the handle of another holder via the threaded ends of the respective paint holders.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself. For instance, handles 14 and 36 can be provided with rubber sleeves to limit lateral slipping within the ladder rung. Alternatively, the handle 14 and 36 can have a length greater than the rung length and provided with an opening through a diameter thereof for receiving a cotter pin. A strap arrangement could be provided with member 12 and 32 which could be wrapped around the ladder frame to limit lateral slipping as well.

I claim:

1. A self-leveling paint bucket holder for use with a ladder having a plurality of rungs for supporting a paint bucket having a pair of diametrically opposed handle protrusions, the bucket holder comprising:

(a) a rigid elliptical member having a major and minor axis and forming an paint can receiving opening, said elliptical member having a paint can receiving means disposed along said minor axis for pivotably receiving the paint can handle protrusions while securingly preventing shifting of the paint can along the major axis, said receiving means facilitating rotation of the paint can about the minor axis to allow self-leveling; and (b) coupling means coupled to said elliptical member proximate said major axis for facilitating rotatably coupling said elliptical member to the ladder for rotation about the major axis.

2. The self-leveling bucket holder as specified in claim 1 wherein said coupling means comprises an elongated shaft extending along the major axis.

3. The self-leveling bucket holder as specified in claim 2 wherein said shaft has a diameter generally between 0.7 and 1.0 inches.

4. The self-leveling bucket holder as specified in claim 1 wherein said coupling means comprises a bracket pivotably secured to said elliptical member for securing said bucket holder to the ladder.

5. The self-leveling bucket holder as specified in claim 1 wherein said paint can receiving means comprises a pair of notches diametrically opposed from the other along the minor axis and opening upwardly.

6. The self-leveling bucket holder as specified in claim 5 wherein said notches have a diameter of approximately ⅞ inches.

7. The self-leveling bucket holder as specified in claim 2 wherein said shaft has a first means at a distal end thereof opposite said elliptical member for coupling said shaft within a tubular ladder rung to another said pan can holder shaft disposed through an opposite end of the same tubular ladder rung.

8. The self-leveling bucket holder as specified in claim 2 wherein said shaft has a first securing means for restraining axially movement of said shaft once adapted within a tubular rung of the ladder.

9. The self-leveling bucket holder as specified in claim 1 wherein said elliptical member is comprised of aluminum.

10. The self-leveling bucket holder as specified in either of claim 4 wherein said bracket is pivotably secured to said member by a single fastener pivotably disposed through said bracket and said member.

11. The self-leveling bucket holder as specified in claim 10 wherein said fastener is a rivet.

12. The self-leveling bucket holder for use with a ladder having a plurality of rungs for supporting a paint bucket having a pair of diametrically opposed handle protrusions receiving the bucket holder comprising:

(a) a rigid semi-elliptical member having a major and minor axis and forming a generally C-shaped paint can receiving receptacle, said member extending between a pair of ends disposed proximate the minor axis, said semi-elliptical member having a paint can receiving means disposed along said minor axis for pivotably receiving the paint can handle protrusions while restricting shifting of the paint can along the major axis, said receiving means facilitating rotation of the paint can about the minor axis to allow self-leveling; and (b) coupling means coupled to said semi-elliptical member proximate said major axis for facilitating rotatably coupling said semi-elliptical member to the ladder for rotation about the major axis.

13. The self-leveling bucket holder as specified in claim 12 wherein said coupling means comprises an elongated shaft extending along the major axis.

14. The self-leveling bucket holder as specified in claim 13 wherein said shaft has a diameter generally between 0.7 and 1.0 inches.

15. The self-leveling bucket holder as specified in claim 12 wherein said coupling means comprises a bracket pivotably secured to said semi-elliptical member for securing said bucket holder to the ladder.

16. The self-leveling bucket holder as specified in claim 12 wherein said paint can receiving means comprises a pair of notches diametrically opposed from the other along the minor axis and opening upwardly.

17. The self-leveling bucket holder as specified in claim 16 wherein said notches have a diameter of approximately 7/8 inches.

18. The self-leveling bucket holder as specified in claim 13 wherein said shaft has a first means at a distal end thereof opposite said elliptical member for coupling said shaft to another said paint can holder disposed through an opposite end of a common tubular ladder rung.

19. The self-leveling bucket holder as specified in claim 13 wherein said shaft has a first securing means for restraining axially movement of said shaft once adapted within a tubular rung of the ladder.

20. The self-leveling bucket holder for use with a ladder having a plurality of rungs for supporting a paint bucket having a pair of diametrically opposed handle protrusions, the bucket holder comprising:

(a) a rigid elliptical member having a major and minor axis and forming an paint can receiving opening, said elliptical member having a paint can receiving means disposed along said minor axis for pivotably receiving the paint can handle protrusions while securingly preventing shifting of the paint can along the major axis, said receiving means facilitating rotation of the paint can about the minor axis to allow self-leveling; and (b) a shaft having a diameter generally between 0.7 and 1.0 inches coupled to said elliptical member proximate said major axis for facilitating rotatably coupling said elliptical member to the ladder for rotation about the major axis.

* * * * *

UNITED STATES PATENT AND TRADEMARK OFFICE

CERTIFICATE OF CORRECTION

PATENT NO. : 5,316,251

DATED : May 31, 1994

INVENTOR(S) : Raymond V. McGraw

It is certified that error appears in the above-indentified patent and that said Letters Patent is hereby corrected as shown below:

In column 9, line 1, before the word "can", "pan" should be changed to -- paint --;

Signed and Sealed this

Thirteenth Day of September, 1994

*Attest:*

*Attesting Officer*

Bruce Lehman

BRUCE LEHMAN

*Commissioner of Patents and Trademarks*